US006148648A

United States Patent [19]

Cagnazzi

[11] Patent Number: 6,148,648

[45] Date of Patent: Nov. 21, 2000

[54] MACHINE FOR MULTIPLE-PASS DYEING OF CORD FABRICS

[75] Inventor: Danilo Cagnazzi, Senago, Italy

[73] Assignee: MCS Officina Meccanica S.p.A., Urgnano, Italy

[21] Appl. No.: 09/168,566

[22] Filed: Oct. 9, 1998

[30] Foreign Application Priority Data

Apr. 22, 1998 [IT] Italy ..... MI98A0855

[51] Int. Cl.[7] ..... D06B 3/10

[52] U.S. Cl. ..... 68/175; 68/179

[58] Field of Search ..... 68/175, 177, 178, 68/179, 9, 27

[56] References Cited

U.S. PATENT DOCUMENTS

| | | | |
|---|---|---|---|
| 3,330,134 | 7/1967 | Carpenter | 68/9 |
| 3,510,251 | 5/1970 | Fujii et al. | 68/177 |
| 3,635,053 | 1/1972 | Daniel | 68/177 |
| 4,006,612 | 2/1977 | Thies | 68/177 |
| 4,020,658 | 5/1977 | Thies, Jr. | 68/27 |
| 4,947,660 | 8/1990 | Von Der Eltz et al. | 68/177 |
| 5,311,627 | 5/1994 | Koch et al. | 68/178 |
| 5,469,720 | 11/1995 | Paggi | 68/178 |

FOREIGN PATENT DOCUMENTS

| | | | |
|---|---|---|---|
| 2935114 | 3/1981 | Germany | 68/175 |

*Primary Examiner*—Frankie L. Stinson
*Attorney, Agent, or Firm*—Oblon, Spivak, McClelland, Maier & Neustadt, P.C.

[57] ABSTRACT

A machine is provided for the multiple-pass dyeing of cord fabrics. The machine includes a dyeing vat containing at least two Overflow or Jet units or funnels, arranged adjacent to each other and associated with at least two reels straddling at least two fabric collecting vats and the at least two Overflow or Jet units or funnels (24–29), so as to pick up the cord fabric contained in the collecting vats and introduce the cord fabric into the Overflow or Jet funnels. The cord fabric is tied into a ring. For the purposes of passing the cord fabric, the collecting vats and Overflow or Jet funnels are connected to each other in a non-sequential manner and in a number lower than the maximum number of fabric collecting vats and Overflow or Jet units or funnels present in the machine. Moreover, in machines equipped with at least four compartments, two of the fabric collecting vats and the Overflow or Jet units or funnels, located next to the opposite ends of the dyeing vat, are connected to each other in series.

2 Claims, 1 Drawing Sheet

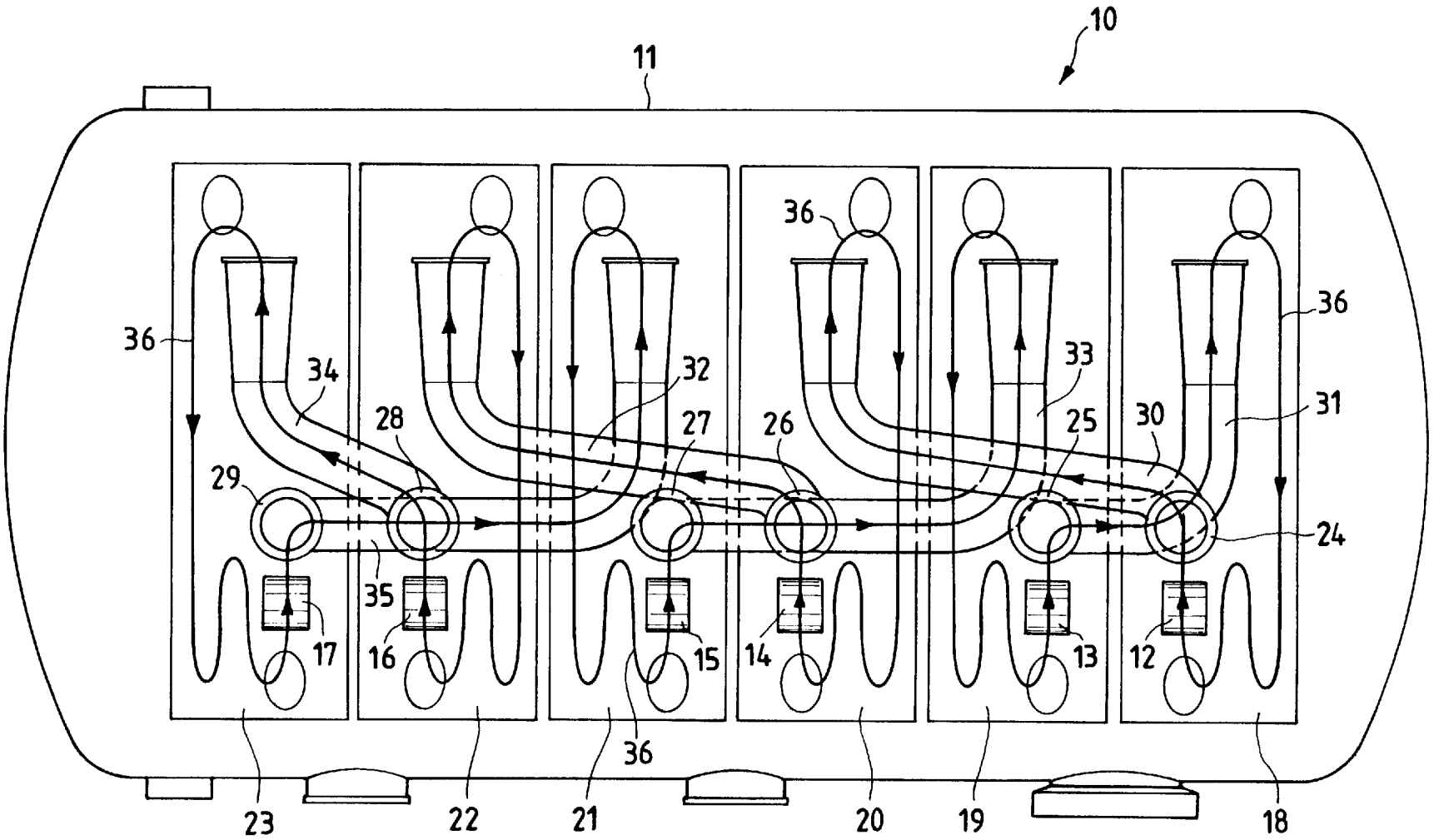
10
11
12
13
14
15
16
17
18
19
20
21
22
23
24
25
26
27
28
29
30
31
32
33
34
35
36

MACHINE FOR MULTIPLE-PASS DYEING OF CORD FABRICS

BACKGROUND OF THE INVENTION

1. Field Of The Invention

The present invention relates to a machine for the multiple-pass dyeing of cord fabrics.

2. Discussion of Background

A number of different solutions have been developed in the field of cord fabric dyeing machines. In fact, the machines known to this date show drawbacks related both to their treating speed and their construction, which must be capable of inducing the fabric to absorb an optimum amount of color so as to achieve a uniform dyeing result.

Considerable progress was achieved thanks to the machine built according to the Italian patent application No. MI93A 01474 (hereinafter "the 474 application") of Jul. 8, 1993, which attempted to provide a solution for the problems encountered up to that point. The contents of the '474 application are incorporated herein by reference.

The '474 application notes that the machine is formed by several overflow or Jet units or funnels arranged in series, through which the cord fabric is passed while tied into a ring. The fabric is subdivided by the number of Overflow or Jet units or funnels constituting the machine and is capable of passing several Overflow or Jet units or funnels in sequence, as many times as needed to dye the fabric, while constantly maintaining the fabric's subdivision.

In particular, in the machine according to the '474 application, the speed of the reels of each Overflow or Jet unit or funnel is syncronized with respect to that of a pilot reel, while slippages of the fabric in any other reel are corrected by a controlling system on the machine, for example in the form of a microprocessor. This synchronization is possible thanks to the fact that the fabric to be dyed is subdivided in as many equal parts as the Overflow or Jet units or funnels constituting the machine, and a magnet is positioned on at least one of these Overflow or Jet units or funnels. An appropriate sensor is provided to signal the passage of the magnet to the microprocessor and to take action to retard or advance the affected reel.

Such a machine, while still operating extremely well in its overall concept, provides, as already mentioned, for passing the fabric from reel to reel in a sequence, from the first to the last and then returning it through a long conduit from the last reel back to the first reel.

In practical terms, this kind of transport of the fabric puts a restriction on the fabric's moving speed, to the point of preventing adequate processing.

The head losses in such a long return conduit limit, due to the fabric's friction on the inner conduit surface, the circulating speed of the piece of fabric, even in a machine equipped with two treating compartments.

These problems relating to the circulation of the piece of fabric are increased out of all proportion in a machine involving several compartments, for instance four or six. In this case, the speed limitation becomes unsustainable and the machine quits working in an industrially acceptable way.

SUMMARY OF THE INVENTION

An object of the invention is to produce a machine for the dyeing of cord fabrics capable of overcoming the technical problem of limiting the circulating speed of the piece of fabric.

Another object of the present invention is to produce a machine for the dyeing of cord fabrics capable of allowing an adequate operation, even, and above all, in the presence of numerous machine compartments.

These objects are achieved according to the present invention by producing a machine for the multiple-pass dyeing of cord fabrics including a dyeing vat containing at least two Overflow or Jet units or funnels arranged one after the other. The at least two Overflow or Jet units or funnels are associated with at least two reels. The at least two reels straddle the same number of fabric collecting vats and the Overflow or Jet units or funnels so as to pick up the cord fabric contained in the fabric collecting vats and introduce the cord fabric into the at least two Overflow or Jet units or funnels. The cord fabric is tied into a ring, characterized in that, for the purposes of passing the cord fabric, the fabric collecting vats and the at least two Overflow or Jet units or funnels are connected to each other in a non-sequential manner and in a number lower than a maximum number of the fabric collecting vats and the at least two Overflow or Jet funnels present in the machine.

The characteristics and advantages of a machine for the multiple-pass dyeing of cord fabrics according to the present invention will be more evident from the following exemplifying and non-limiting description, referring to the simplified drawing attached, which shows a plan view of such a machine.

BRIEF DESCRIPTION OF THE DRAWING

FIG. 1 is a cross-sectional view through a machine for multiple-pass dyeing of cord fabric of the present invention.

With reference to FIG. 1, a machine for the multiple-pass dyeing of cord fabric is shown and indicated as a whole by the number 10, comprising a dyeing vat 11 for an Overflow or Jet process, containing a multiple number of Overflow or Jet units or funnels.

Moreover, the vat interior has a number of compartments containing a multiple number of reels 12, 13, 14, 15, 16 and 17 arranged in series.

In the example shown, there are six compartments but may rank from a minimum of two to more than six compartments, depending on the user's needs and requirements.

The reels 12, 13, 14, 15, 16 and 17 are positioned in a manner to straddle an equal number of collecting vats, shown in a simplified manner by 18, 19, 20, 21, 22 and 23, respectively, and of the same number of Overflow or Jet units or funnels shown by 24, 25, 26, 27, 28 and 29.

Moreover, according to the invention, some conduits 30, 31, 32, 33, 34 and 35 are provided to connect the collecting vats and as many Overflow or Jet units or funnels, not arranged in series.

The reels 12–17 pick up the cord fabric, shown in a simplified manner by a dashed and dotted line in 36 and contained in the vats 18–23, and introduce the cord fabric to the respective Overflow or Jet units or funnels 24–29.

In particular, in the example shown, the fabric 36 contained in the vat 18 is passed by the reel 12 to the funnel 24 and then to the conduit 30. This conduit 30 is arranged according to the present invention and arrives at the collecting vat 20 in which the conduit 30 introduces the piece of fabric.

The fabric 36 contained in the collecting vat 20 is passed by the reel 14 into the Overflow or Jet unit or funnel 26 and then into the conduit 32. This conduit, also arranged according to the present invention, arrives at the collecting vat 22, not arranged into series, in which the conduit 32 introduces the piece of fabric.

As can be seen, the fabric 36 contained in the collecting vat 22 is subsequently passed by the reel 16 to the Overflow or Jet unit or funnel 28 and then to the conduit 34, from where it the fabric 36 is conveyed to the following vat 23.

The flow of the fabric to the remaining compartments occurs in the same manner as described above.

In fact, the fabric 36 contained in the collecting vat 23 is passed by the reel 17 to the Overflow or Jet unit or funnel 29 and then to the conduit 35. This conduit 35 arrives at the collecting vat 21, arranged according to the present invention into a non-serial manner, in which it the conduit 35 introduces the piece of fabric.

The fabric 36 contained in the collecting vat 21 is then passed by the reel 15 to the Overflow or Jet unit or funnel 27 and then into the conduit 33, which arrives at the collecting vat 19, also not arranged into series, in which the conduit 33 introduces the piece of fabric 36.

Finally, the fabric 36 contained in the collecting vat 19 is passed by the reel 13 to the Overflow or Jet unit or funnel 25 and then into the conduit 31, from which the fabric 36 is again conveyed to the first vat 18, thus concluding the path of the piece of fabric.

This achieves the transport across sections of conduit, not of great length, which in no way limit the circulating speed of the piece.

The transport conduits are between them of comparable length and therefore allow an identical transport speed of the fabric for the various machines, independently of the number of compartments the machines contain.

This solves the technical problem present of the machines based on the prior art, in an extremely simple and entirely novel manner.

The present invention is equally valid for machines having two compartments, but finds its optimum application in machines having two or more compartments.

What is claimed is:

1. A machine for multiple-pass dyeing of cord fabrics, said machine comprising a dyeing vat;

at least two Overflow or Jet funnels arranged one after another;

at least two reels, wherein each reel of said at least two reels is associated with said at least two Overflow or Jet funnels;

at least two fabric collecting vats, wherein both said at least two collecting vats and said at least two Overflow or Jet funnels are straddled by said at least two reels so as to pick up the cord fabric contained said at least two fabric collecting vats and introduce the cord fabric into said at least two Overflow or Jet funnels, the cord fabric being tied into a ring; and wherein, for passing the cord fabric, said at least two fabric collecting vats and said at least two Overflow or Jet funnels are connected to each other in a non-sequential manner and in a number lower than a maximum number of said at least two fabric collecting vats and said at least two Overflow or Jet funnels present in said machine.

2. The machine according to claim 1, further comprising at least four compartments, wherein said at least two fabric collecting vats and said at least two Overflow or Jet funnels, which are located next to opposite extremities of said dyeing vat, are connected to each other in series.

* * * * *